US007836832B2

(12) United States Patent
Boyd et al.

(10) Patent No.: US 7,836,832 B2
(45) Date of Patent: Nov. 23, 2010

(54) STOWABLE FOLD-OUT/ROLL-OUT DINETTE TABLE ASSEMBLY

(75) Inventors: Joshua Stafford Boyd, Kirkland, WA (US); Daniel R. Kieffer, Kirkland, WA (US)

(73) Assignee: PACCAR Inc, Bellevue, WA (US)

( * ) Notice: Subject to any disclaimer, the term of this patent is extended or adjusted under 35 U.S.C. 154(b) by 629 days.

(21) Appl. No.: 11/674,488

(22) Filed: Feb. 13, 2007

(65) Prior Publication Data

US 2008/0190329 A1 Aug. 14, 2008

(51) Int. Cl.
*A47B 1/06* (2006.01)

(52) U.S. Cl. ..... 108/40; 108/68; 108/143; 312/297; 312/317.3; 312/318

(58) Field of Classification Search ..... 108/67–68, 108/33, 40–41, 39, 143; 312/297, 273–274, 312/317.3, 318, 309–311, 321.5, 321, 324, 312/349–350

See application file for complete search history.

(56) References Cited

U.S. PATENT DOCUMENTS

| | | | | |
|---|---|---|---|---|
| 359,817 | A | 3/1887 | Schmitt | |
| 419,978 | A | 1/1890 | Taylor | |
| 492,284 | A | 2/1893 | Graaff | |
| 504,072 | A | 8/1893 | Waters | |
| 508,938 | A | 11/1893 | Hamilton | |
| 531,010 | A | 12/1894 | Sigafoos | |
| 540,920 | A * | 6/1895 | Mainardi | 108/68 |
| 575,759 | A | 1/1897 | Pickett | |
| 960,594 | A | 6/1910 | Snyder | |
| 963,502 | A * | 7/1910 | Bond | 108/68 |
| 1,950,927 | A * | 3/1934 | McMillan | 296/181.4 |
| 2,431,830 | A * | 12/1947 | Rose | 348/842 |
| 2,527,056 | A * | 10/1950 | Cain | 108/93 |
| 2,588,706 | A | 3/1952 | Davis | |
| 2,726,911 | A | 12/1955 | Mason | |
| 2,788,698 | A | 4/1957 | Wickstrom | |
| 2,848,291 | A | 8/1958 | Hafekost | |
| 2,869,956 | A | 1/1959 | Gaines | |
| 3,623,166 | A | 11/1971 | Wilkinson | |
| 3,636,548 | A | 1/1972 | Maruzzelli | |
| 3,896,742 | A | 7/1975 | Ferraro | |
| 4,263,854 | A * | 4/1981 | Moore et al. | 108/37 |
| 4,718,354 | A | 1/1988 | Piretti | |
| 6,308,641 | B1 * | 10/2001 | Kingbury | 108/42 |

FOREIGN PATENT DOCUMENTS

| | | | |
|---|---|---|---|
| DE | 4308495 | * | 9/1993 |
| DE | 19935762 | * | 2/2001 |

* cited by examiner

*Primary Examiner*—Hanh V Tran
(74) *Attorney, Agent, or Firm*—Christensen O'Connor Johnson Kindness PLLC

(57) ABSTRACT

A stowable table assembly (10) includes a frame (14) having first and second side rails (16 and 18), wherein the frame (14) is selectively translatable between at least a stowed position and an extended position. The stowable table assembly (10) further includes a track (29,29) in communication with the first and second side rails (16 and 18) and a flexible element (12) slidably disposed within at least one of the track (29,29) or the first and second guide rails (16 and 18).

19 Claims, 3 Drawing Sheets

Fig.1.
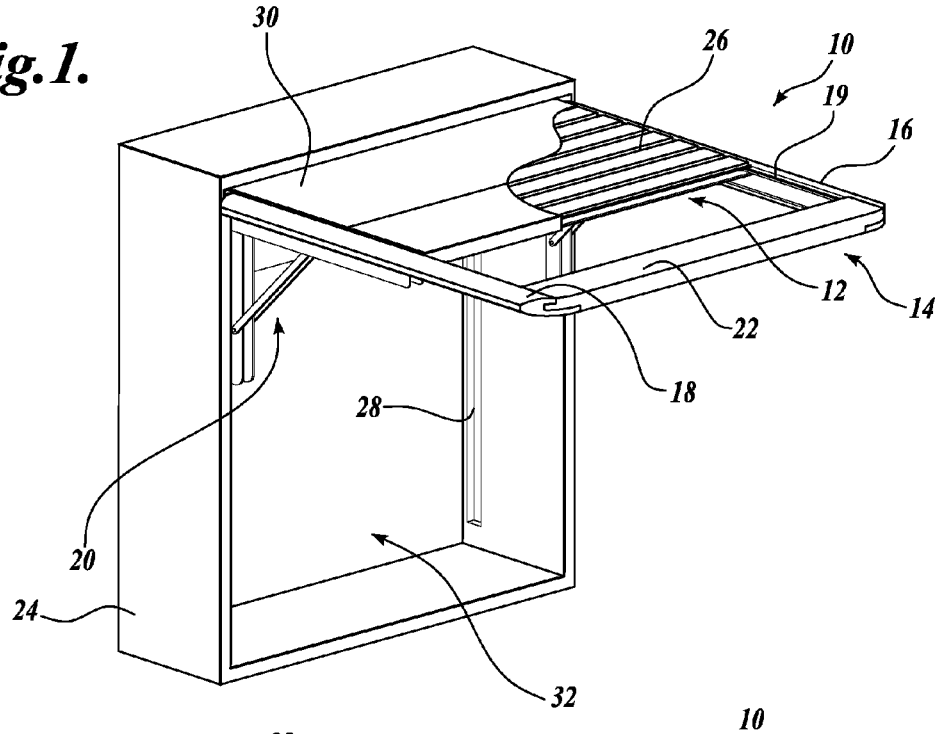
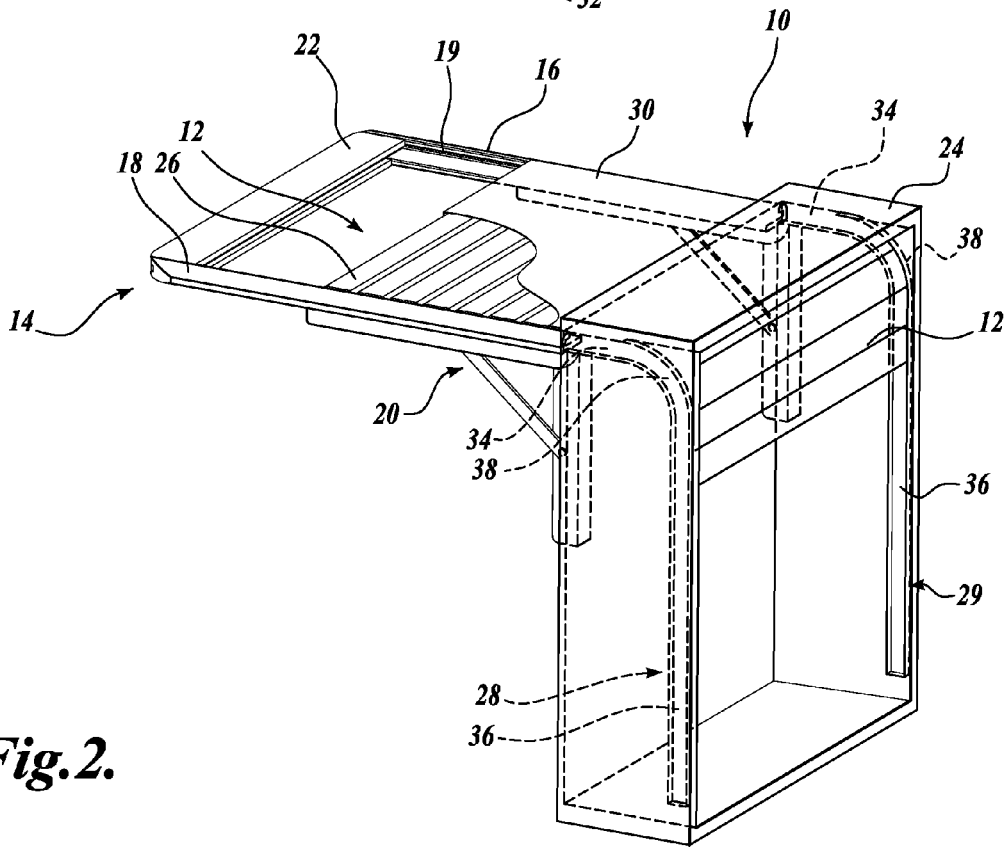
Fig.2.

Fig.4.
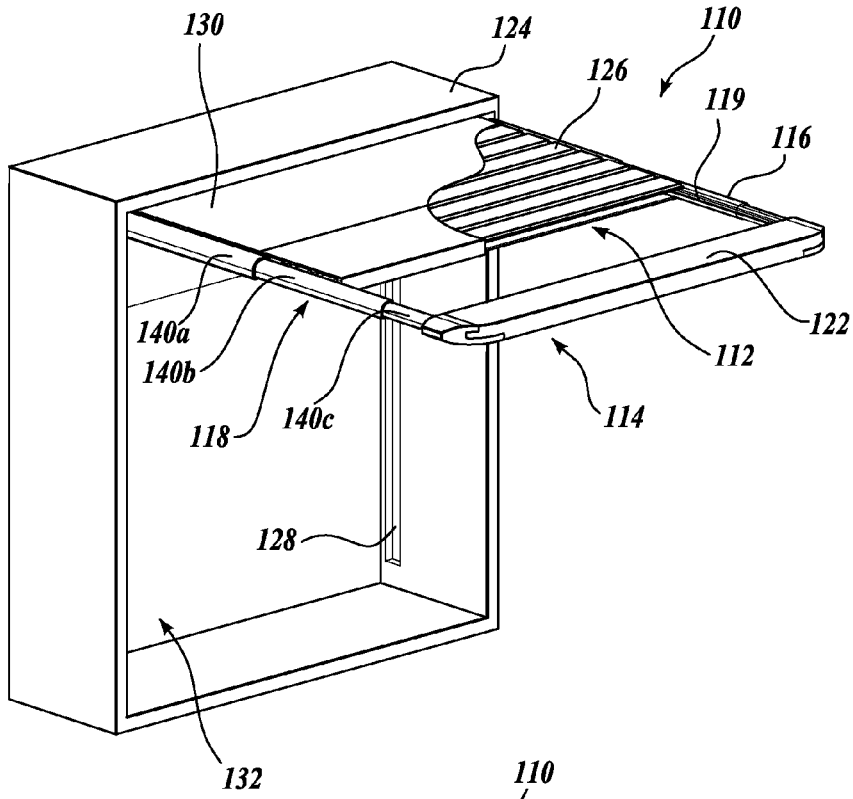
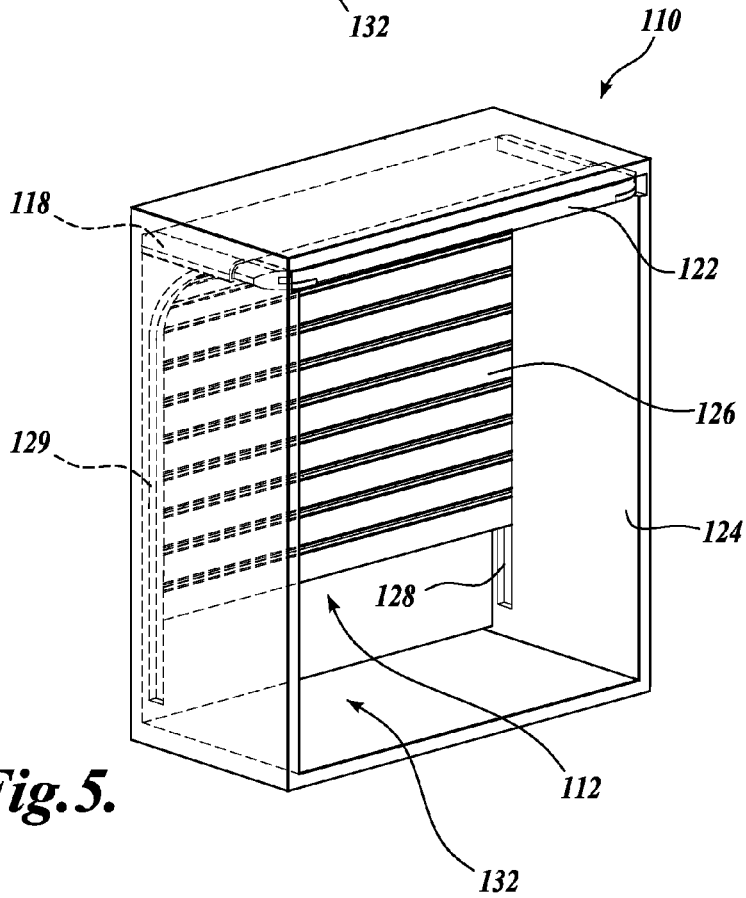
Fig.5.

STOWABLE FOLD-OUT/ROLL-OUT DINETTE TABLE ASSEMBLY

BACKGROUND

In a tightly-confined living space, dinette tables often need to be collapsible and/or stowable so as to create more room when not in use. Stowable dinette assemblies typically use a single table member that is hingedly coupled to a wall, wherein the table member is stored flat against the wall when not in use. When the table member is stored parallel and flat against the wall, deployment of the table member is necessary to access any storage space behind the table member. This is extremely inconvenient in small spaces where all storage space must be used.

As a non-limiting example, the interior of truck sleepers are very limited in space, and all inboard space must be used for cabinets or storage. Thus, if a table member is stored flat against an opening in the wall of the truck sleeper, the table member must be lifted into the deployed position each time the storage space must be accessed. Thus, a more convenient design is desired.

SUMMARY

A stowable table assembly includes a frame having first and second side rails, wherein the frame is selectively translatable between at least a stowed position and an extended position. The stowable table assembly further includes a track in communication with the first and second side rails and a flexible element slidably disposed within at least one of the track or the first and second guide rails.

This summary is provided to introduce a selection of concepts in a simplified form that are further described below in the Detailed Description. This summary is not intended to identify key features of the claimed subject matter, nor is it intended to be used as an aid in determining the scope of the claimed subject matter.

DESCRIPTION OF THE DRAWINGS

The foregoing aspects and many of the attendant advantages of the subject matter described herein will become more readily appreciated by reference to the following detailed description, when taken in conjunction with the accompanying drawings, wherein:

FIG. 1 is an isometric view of a stowable table assembly constructed in accordance with one embodiment of the present disclosure, wherein the stowable table assembly is in the extended position;

FIG. 2 is a rear isometric view of the stowable table assembly of FIG. 1;

FIG. 4 is a front isometric view of a alternate embodiment of a stowable table assembly in the extended position; and FIG. 5 is a front isometric view of the stowable table assembly of FIG. 2 shown in the collapsed position.

DETAILED DESCRIPTION

Figure 3:
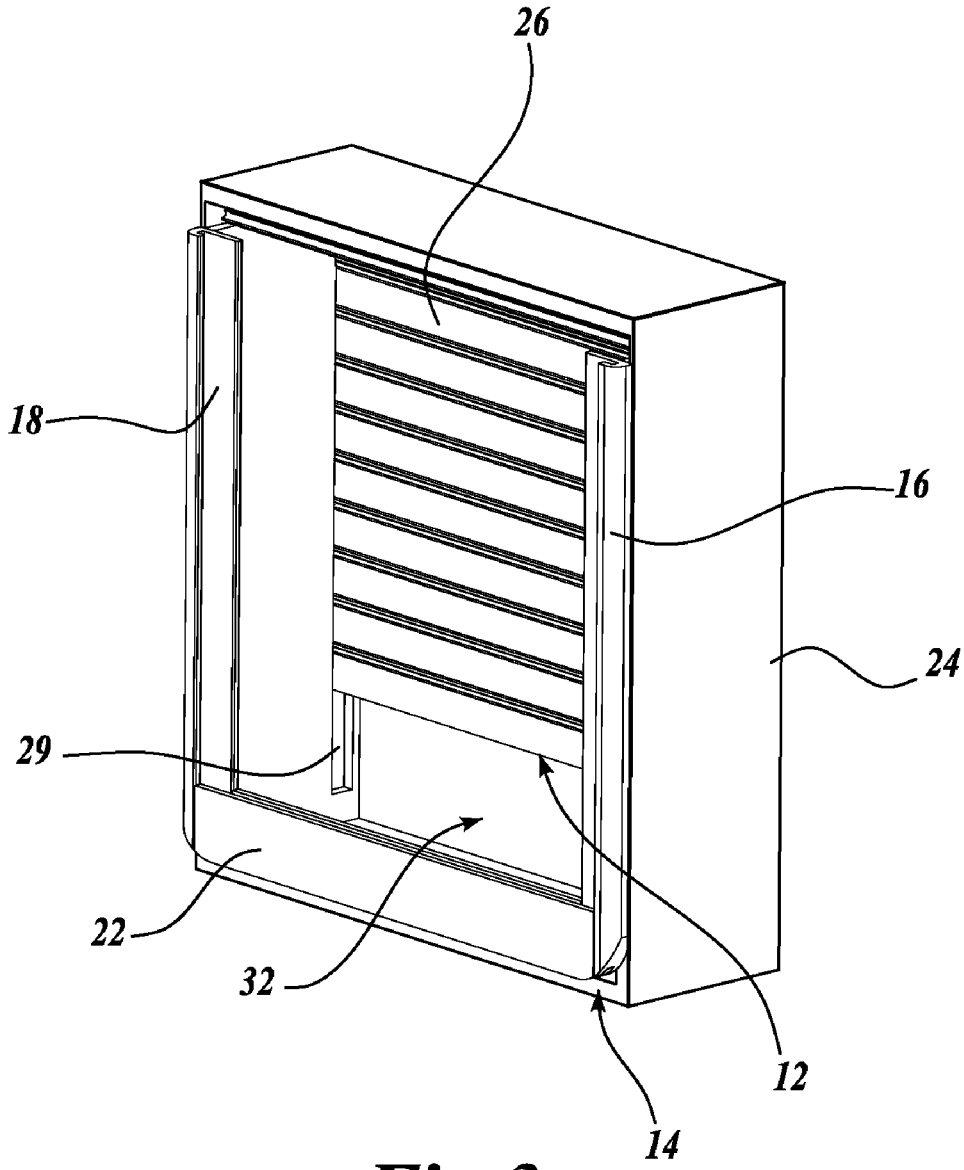
FIG. 3 is a front isometric view of the stowable table assembly of FIG. 1 shown in the collapsed position.

A stowable table assembly 10 constructed in accordance with one embodiment of the present disclosure is best seen by referring to FIG. 1. The stowable table assembly 10 includes a frame 14 having parallel first and second side rails 16 and 18 disposed opposite one another. The first and second side rails 16 and 18 are coupled at one of their proximal ends to any suitable substantially vertical mounting medium 24, such as a cabinet, wall, etc. Preferably, the vertical mounting medium 24 defines a vertical mounting medium interior 32 that may be used for storage or similar uses. The proximal ends of first and second side rails 16 and 18 opposite vertical mounting medium 24 are joined by a transversely disposed end member 22.

The frame 14 is pivotally coupled to the vertical mounting medium 24 with any suitable folding bracket or hinge. Preferably, the first and second side rails 16 and 18 are pivotally coupled at their proximal ends to the vertical mounting medium 24 with a suitable self-locking folding bracket 20. The self-locking folding bracket 20 allows the frame 14 to be translated between a collapsed position, wherein the frame 14 is positioned adjacent the vertical mounting medium 24, and an extended position, wherein the frame 14 extends outwardly and substantially orthogonally from the mounting medium 24. The self-locking folding bracket 20 temporarily "locks" when the frame 14 is in the extended position to maintain the frame's position.

The first and second side rails 16 and 18 include side rail tracks 19 formed on the interior of the first and second side rails 16 and 18 for slidably receiving a flexible element, or a table segment assembly 12. The side rail tracks 19 may include a bearing assembly or other low friction means for reducing the friction between the side rail track 19 and the table segment assembly 12. For instance, the side rail tracks 19 may be formed with a suitable low-friction material, such as, but not limited to, Delrin®, which would allow the table segment assembly 12 to slide freely within the side rail tracks 19.

Referring to FIG. 2, the table segment assembly 12 includes a plurality of interlocking longitudinal extrusions, or hinged segments 26 that are hingedly coupled to one another along their longitudinal edges to form a suitable table segment assembly 12. A flexible table top 30 encloses the hinged segments 26 therewithin such that the hinged connections are not exposed to a user and a smooth surface is provided for use.

The table segment assembly 12 is slidably receivable within first and second vertical tracks 28 and 29 formed within the vertical mounting medium hollow interior 32. Each track 28 and 29 is preferably formed on each interior side surface of the vertical mounting medium 24. The tracks 28 and 29 are substantially the same size and shape and are disposed on the interior of the vertical mounting medium 24 such that the tracks 28 and 29 substantially mirror each other.

Each track 28, 29 slidably receives a lateral edge of the table segment assembly 12. The tracks 28 and 29 may include a bearing assembly or other low-friction means for reducing the friction between the tracks 28 and 29 and the table segment assembly 12 when the table segment assembly 12 is slidably received therewithin. For example, the tracks 28 and 29 may be composed of a low-friction material, such as, but not limited to, Delrin®. Moreover, the table segment assembly 12 may be composed of a non-friction material, such as UHMW polyethylene or Nylatron®, such that the table segment assembly 12 may slide freely within the tracks 28 and 29 and the side rail tracks 19. It should be appreciated that the tracks 28 and 29 could instead be formed as one track, or a slot within the vertical mounting medium 24 for slidably receiving the table segment assembly 12.

The tracks 28 and 29 include a substantially vertical portion 36, a substantially horizontal portion 34, and a curved portion 38 interconnecting the vertical portion 36 and the horizontal portion 34. The horizontal portion 34 substantially aligns with the side rail tracks 19 formed on the interior of the first and second side rails 16 and 18 when the frame 14 is in the extended position. Therefore, when the frame 14 is extended, the table segment assembly 12 may be slidably translated between the first and second side rails 16 and 18 and the tracks 28 and 29.

To use the stowable table assembly 10, the first and second side rails 16 and 18 of the frame 14 are lifted upwardly about the pivotal axis defined by the self-locking folding bracket 20 until the frame 14 is positioned substantially orthogonal to the vertical mounting medium 24. In this extended position, the side rail tracks 19 of the first and second side rails 16 and 18 align with the horizontal portion 34 of the tracks 28. Moreover, the self-locking folding bracket 20 "locks" the frame 14 in place and at least temporarily maintains the extended position of the frame 14.

With the frame 14 in the extended position, the table segment assembly 12 is pulled upwardly and outwardly from the tracks 28 and 29 and is slidably received within the first and second side rails 16 and 18 of the frame 14. The table segment assembly 12 is slidably translated within the side rail tracks 19 of the first and second side rails 16 and 18 until the assembly 12 abuts the end member 22. In this manner, the fully deployed table segment assembly 12 and frame 14 cooperatively form a table that may be used in any suitable manner by the end user.

Referring to FIG. 3, the stowable table assembly 10 is stored in a collapsed position when not in use. To move the assembly 10 into the collapsed position, the table segment assembly 12 is first slidably translated within the side rail tracks 19 of the first and second side rails 16 and 18 away from the end member 22. The table segment assembly 12 is slidably received within the tracks 28 and 29 until the table segment assembly 12 is no longer disposed within the frame 14. The frame 14 is folded downwardly from the extended position (as shown in FIG. 1) until the frame 14 is positioned adjacent the vertical mounting medium 24, thereby displacing the stowable table assembly 10 into the collapsed position.

When the table segment assembly 12 is received within the tracks 28 and 29 and the frame 14 is in the collapsed position, the vertical mounting medium interior 32 is accessible through the frame 14. More specifically, the first and second side rails 16 and 18 and the end member 22 cooperatively define an opening in the frame 14. Thus, with the frame 14 stored against the vertical mounting medium 24, a user may access the vertical mounting medium interior 32. Accordingly, the vertical mounting medium interior 32 may be used as storage space that is accessible even when the frame 14 is collapsed.

Now referring to FIG. 4, a first alternate embodiment of a stowable table assembly 110 is depicted, wherein like numerals refer to like parts. The stowable table assemblies 10 and 110 are substantially identical except for the differences which will be hereinafter described. The stowable table assembly 110 includes a frame 114 having parallel first and second slidable segment assemblies 116 and 118 disposed opposite one another with an end member 122 transversely disposed therebetween. The first and second slidable segment assemblies 116 and 118 are comprised of a plurality of nesting slidable segments. Preferably, each assembly 116 and 118 includes slidable segments 140*a*, 140*b*, and 140*c*, wherein slidable segment 140*b* is received within slidable segment 140*a* and slidable segment 140*c* is received within slidable segment 140*b*. The slidable segments 140*a*, 140*b*, and 140*c* may be slidably coupled together in a telescoping fashion or in any other well-known manner.

The slidable segment assemblies 116 and 118 include an extendable rail track 119 formed on the interior of the slidable segment assemblies 116 and 118. When the slidable segment assemblies 116 and 118 are fully extended, the extendable rail track 119 aligns with the horizontal portion (not shown) of the tracks 128 and 129. In this manner, the table segment assembly 112 may be pulled upwardly and outwardly from the track 128 and received into the extendable rail tracks 119 of the first and second slidable segment assemblies 116 and 118 such that the stowable table assembly 110 is in the deployed position.

Referring to FIG. 5, the stowable table assembly 110 is collapsed by first slidably translating the table segment assembly 112 along the extendable track 119 and into the tracks 128 and 129 within the vertical mounting medium 124. The table segment assembly 112 is slidably translated until it is fully received within the tracks 128 and 129 within the vertical mounting medium 124. The first and second slidable segment assemblies 116 and 118 may be thereafter collapsed and received within a horizontal recess (not shown) within the vertical mounting medium, as shown in FIG. 5.

When the table segment assembly 112 is fully received within the tracks 128 and 129 and the frame 114 is collapsed within the horizontal recess within the vertical mounting medium 124, the vertical mounting medium interior 132 is unobstructed by the table assembly 110. In this manner, items stored within the vertical mounting medium interior 132 may be accessed when the stowable table assembly 110 in both in the collapsed and deployed positions.

While illustrative embodiments have been illustrated and described, it will be appreciated that various changes can be made therein without departing from the spirit and scope of the invention.

The embodiments of the invention in which an exclusive property or privilege is claimed are defined as follows:

1. A stowable table assembly, comprising:

(a) a frame including first and second side rails defining first and second opposing rail tracks, the frame selectively translatable between at least a stowed position and an extended position;

(b) a track having a substantially horizontal portion and a substantially vertical portion, the substantially horizontal portion in communication with the first and second rail tracks of the first and second side rails when the frame is in the extended position; and (c) a flexible element comprising front, rear and side edges defining a supporting surface, said flexible element slidably receivable within the track and the rail tracks of the first and second side rails, wherein the flexible element is positioned between the first and second side rails with each side edge of the flexible element is slidably received within the respective first and second rail tracks when the frame is in the extended position to provide a table surface.

2. The stowable table assembly of claim 1, wherein the flexible element is slidably disposed within the track when the frame is in the stowed position.

3. The stowable table assembly of claim 1, wherein the frame is positioned substantially parallel to a vertical portion of the track when the frame is in the stowed position.

4. The stowable table assembly of claim 1, wherein the first and second side rails extend outwardly from the substantially horizontal portion of the track when the frame is in the extended position such that the rail tracks of the first and second side rails form an extension of the substantially horizontal portion of the track.

5. The stowable table assembly of claim 1, wherein the track is formed within a substantially vertical mounting medium and the first and second side rails of the frame are hingedly coupled at one end to the substantially vertical mounting medium.

6. The stowable table assembly of claim 5, further comprising an end member disposed between the first and second side rails, wherein an opening is defined between the side rails and the end member for accessing the substantially vertical mounting medium when the frame is in the stowed position.

7. The stowable table assembly of claim 1, wherein the track is formed within a substantially vertical mounting medium and the frame is hingedly coupled to the vertical mounting medium with at least one collapsible L-bracket having a locking mechanism for maintaining the frame in the extended position.

8. The stowable table assembly of claim 1, wherein the first and second side rails of the frame are composed of slidable segments such that the first and second side rails are collapsed within a horizontal recess formed in a substantially vertical mounting medium when the frame is in the stowed position, and wherein the side rails are at least partially extended outwardly from the horizontal recess when the frame is in the extended position.

9. A stowable table assembly, comprising:

(a) a track having a substantially horizontal portion and a substantially vertical portion;

(b) a flexible element comprising front, rear and side edges defining a supporting surface, said flexible element selectively displaceable between at least a first position, wherein the flexible element is slidably received within the track, and a second position, wherein the flexible element is pulled upwardly and outwardly from the track; and (c) a frame selectively translatable between at least a stowed position and an extended position, the frame including first and second side rails defining first and second opposing rail tracks, wherein when the frame is in the extended position the rail tracks of the first and second side rails are in communication with the substantially horizontal portion of the track and are adapted to slidably receive the flexible element, such that with each side edge of the flexible element is slidably received within the respective first and second rail tracks the flexible element is positioned between the first and second side to provide a table surface.

10. The stowable table assembly of claim 9, wherein the frame is positioned substantially parallel to a vertical portion of the track when the frame is in the stowed position.

11. The stowable table assembly of claim 9, wherein the first and second side rails extend outwardly from the horizontal portion of the track when the frame is in the extended position such that the rail tracks of the first and second side rails form an extension of the horizontal portion of the track.

12. The stowable table assembly of claim 9, wherein the track is formed within a substantially vertical mounting medium and the first and second side rails of the frame are hingedly coupled at one end to the substantially vertical mounting medium.

13. The stowable table assembly of claim 9, further comprising an end member disposed between the first and second side rails, wherein an opening is defined between the side rails and the end member for accessing the substantially vertical mounting medium when the frame is in the stowed position.

14. The stowable table assembly of claim 9, wherein the track is formed within a substantially vertical mounting medium and the frame is hingedly coupled to the substantially vertical mounting medium with at least one collapsible L-bracket having a locking mechanism for maintaining the frame in the extended position.

15. The stowable table assembly of claim 9, wherein the first and second side rails of the frame are composed of slidable segments such that the first and second side rails are collapsed within a horizontal recess formed in a substantially vertical mounting medium when the frame is in the stowed position.

16. The stowable table assembly of claim 15, wherein the first and second side rails are at least partially extended outwardly from the horizontal recess when the frame is in the extended position.

17. A stowable table assembly, comprising:

(a) a track formed within a substantially vertical mounting medium, the track having a substantially horizontal portion and a substantially vertical portion;

(b) an extendable frame composed of first and second pairs of slidable segment assemblies, the first and second pairs of slidable segment assemblies defining opposable first and second extendable rail tracks, wherein the first and second pairs of slidable segment assemblies are collapsed within a horizontal recess formed in the substantially vertical mounting medium when the frame is in a collapsed position, and wherein the first and second pairs of slidable segment assemblies are at least partially extended outwardly from the horizontal recess when the frame is in an extended position, wherein when the first and second pairs of slidable segment assemblies are in the extended position the first and second rail tracks are in communication with the substantially horizontal portion of the track; and (c) a flexible element selectively displaceable between at least a first position, wherein the flexible element is slidably received within the track formed in the substantially vertical mounting medium, and a second position, wherein the flexible element is slidably received within the first and second rail tracks such that the flexible element is positioned between the first and second pairs of slidable segment assemblies of the frame to provide a table surface.

18. The stowable table assembly of claim 17, wherein the flexible element is slidably disposed within the track when the frame is in the stowed position, and wherein the flexible element is slidably disposed within the frame when the frame is in the extended position.

19. The stowable table assembly of claim 17, wherein the frame extends outwardly from a horizontal portion of the track when the frame is in the extended position such that the first and second rail tracks form an extension of the horizontal portion of the track.

* * * * *

UNITED STATES PATENT AND TRADEMARK OFFICE

CERTIFICATE OF CORRECTION

PATENT NO. : 7,836,832 B2
APPLICATION NO. : 11/674488
DATED : November 23, 2010
INVENTOR(S) : J. S. Boyd et al.

It is certified that error appears in the above-identified patent and that said Letters Patent is hereby corrected as shown below:

| COLUMN | LINE | ERROR |
|---|---|---|
| 5 (Claim 9, | 44 line 22) | "side to" should read --side rails to-- |

Signed and Sealed this
Fifteenth Day of March, 2011

David J. Kappos
*Director of the United States Patent and Trademark Office*